United States Patent [19]

Hashimoto et al.

[11] Patent Number: 5,030,300

[45] Date of Patent: Jul. 9, 1991

[54] AMORPHOUS ALUMINUM ALLOYS

[75] Inventors: Koji Hashimoto, 2-25-5, Shogen, Sendai-shi, Miyagi-ken; Hideaki Yoshioka, Sendai; Katsuhiko Asami, Sendai; Asahi Kawashima, Sendai, all of Japan

[73] Assignees: Yoshida Kogyo K.K.; Koji Hashimoto, Tokyo, Japan

[21] Appl. No.: 454,412

[22] Filed: Dec. 21, 1989

Related U.S. Application Data

[63] Continuation of Ser. No. 183,981, filed Apr. 20, 1988, now abandoned.

[30] Foreign Application Priority Data

Apr. 28, 1987 [JP] Japan ..... 62-103296
Mar. 7, 1988 [JP] Japan ..... 63-51567
Mar. 7, 1988 [JP] Japan ..... 63-51568

[51] Int. Cl.[5] ..... C22C 21/00; C22C 14/00; C22C 27/02; C22C 27/04

[52] U.S. Cl. ..... 148/403; 420/418; 420/422; 420/425; 420/426; 420/427; 420/429; 420/430; 420/552; 420/580

[58] Field of Search ..... 148/403

[56] References Cited

U.S. PATENT DOCUMENTS 4,842,817 6/1989 Huang et al. ..... 420/407

FOREIGN PATENT DOCUMENTS 0289835 11/1988 European Pat. Off. .

*Primary Examiner*—R. Dean
*Assistant Examiner*—David W. Schumaker
*Attorney, Agent, or Firm*—Hill, Van Santen, Steadman & Simpson

[57] ABSTRACT

An amorphous aluminum-refractory metal alloy with special characteristics such as high corrosion resistance, high wear resistance and considerable toughness, consisting of Al and at least one element selected from refractory metals of Ta, Nb, Mo and W, a portion of the set forth refractory metals being allowed to be substituted with at least one element selected from Ti and Zr.

4 Claims, 1 Drawing Sheet

AMORPHOUS ALUMINUM ALLOYS

This is a continuation of application Ser. No. 183,981, filed Apr. 20, 1988, now abandoned.

BACKGROUND OF THE INVENTION

1. Field of the Invention

The present invention relates to novel amorphous aluminum-refractory metal alloys with special characteristics such as high corrosion resistance, high wear resistance and considerable toughness, which alloys are useful in industrial plants such as chemical plants and other various industrial or domestic applications.

2. DESCRIPTION OF THE PRIOR ART

Corrosion-resistant aluminum alloys have heretofore been widely used in various fields. On the other hand, Ti, Zr, Nb, Ta, Mo and W belong to refractory metals. Melting points of Nb, Ta, Mo and W are higher than the boiling point of Al. It is, therefore, difficult to apply conventional methods including melting for production of Al alloys with Nb, Ta, Mo and W and for production of these Al alloys in which a portion of Nb, Ta, Mo and W are substituted with Ti and/or Zr.

Most of the passive films, which can protect metallic materials in mild environments, suffer break down in hydrochloric acids. Because of severe corrosiveness of hydrochloric acids, there are no metallic materials which are corrosion resistant in hydrochloric acids. Currently used aluminum alloys are no exceptions.

In view of the above-foregoing, there has been a strong demand for further new metallic materials which can be used in such severe environments, that corrode almost all currently used metallic materials.

SUMMARY OF THE INVENTION

It is an objective of the present invention to provide an aluminum-refractory metal alloy, which is hardly produced by conventional method including melting, and which is not a heterogeneous crystalline alloy but an amorphous alloy having special characteristics such as high corrosion resistance, high wear resistance and considerable toughness.

The objective of the invention is achieved by an amorphous Al alloy with Ta, Nb, Mo and W as essential elements, which are partially substituted with Ti and/or Zr.

According to the present invention, the following alloys are provided:

(1) Amorphous aluminum-refractory metal alloys with special characteristics such as high corrosion resistance, high wear resistance and considerable toughness, which consists of 7–75 at. % of at least one element selected from a group of Ta and Nb, the balance being substantially Al.

(2) Amorphous aluminum-refractory metal alloys with special characteristics such as high corrosion resistance, high wear resistance and considerable toughness, which consists of at least one element selected from a group of Ta and Nb and at least one element selected from a group of Ti and Zr, at least one element selected from the group of Ta and Nb being at least 5 at. %, the sum of at least one element selected from the group of Ta and Nb and at least one element selected from the group of Ti and Zr being from 7 to 75 at. %, the balance being substantially Al.

(3) Amorphous aluminum-refractory metal alloys with special characteristics such as high corrosion resistance, high wear resistance and considerable toughness which consists of 7–50 at. % of at least one element selected from a group of Mo and W, the balance being substantially Al.

(4) Amorphous aluminum-refractory metal alloys with special characteristics such as high corrosion resistance, high wear resistance and considerable toughness, which consists of at least one element selected from a group of Mo and W and at least one element selected from a group of Ti and Zr, at least one element selected from the group of Mo and W being at least 5 at. %, the sum of at least one element selected from the group of Mo and W and at least one element selected from the group of Ti and Zr being 7–50 at. %, the balance being substantially Al.

(5) Amorphous aluminum-refractory metal alloys with special characteristics such as high corrosion resistance, high wear resistance and considerable toughness, which consists of at least one element selected from a group of Mo and W and at least one element selected from a group of Ta and Nb, at least one element selected from the group of Mo and W being less than 50 at. %, the sum of at least one element selected from the group of Mo and W and at least one element selected from the group of Ta and Nb being 7–75 at. %, the balance being substantially Al.

(6) Amorphous aluminum-refractory metal alloys with special characteristics such as high corrosion resistance, high wear resistance and considerable toughness, which consists of at least one element selected from a group of Mo and W, at least one element selected from a group of Ta and Nb and at least one element selected from a group of Ti and Zr, at least one element selected from the group of Mo and W being less than 50 at. %, the sum of at least one element selected from the group of Mo and W and at least one element selected from the group of Ta and Nb being at least 5 at. %, the sum of elements in three groups, that is, at least one element selected from the group of Mo and W, at least one element selected from the group of Ta and Nb, and at least one element selected from the group of Ti and Zr being 7 to 75 at. %, the balance being substantially Al.

DETAILED DESCRIPTION OF THE PREFERRED EMBODIMENTS

Figure 1:
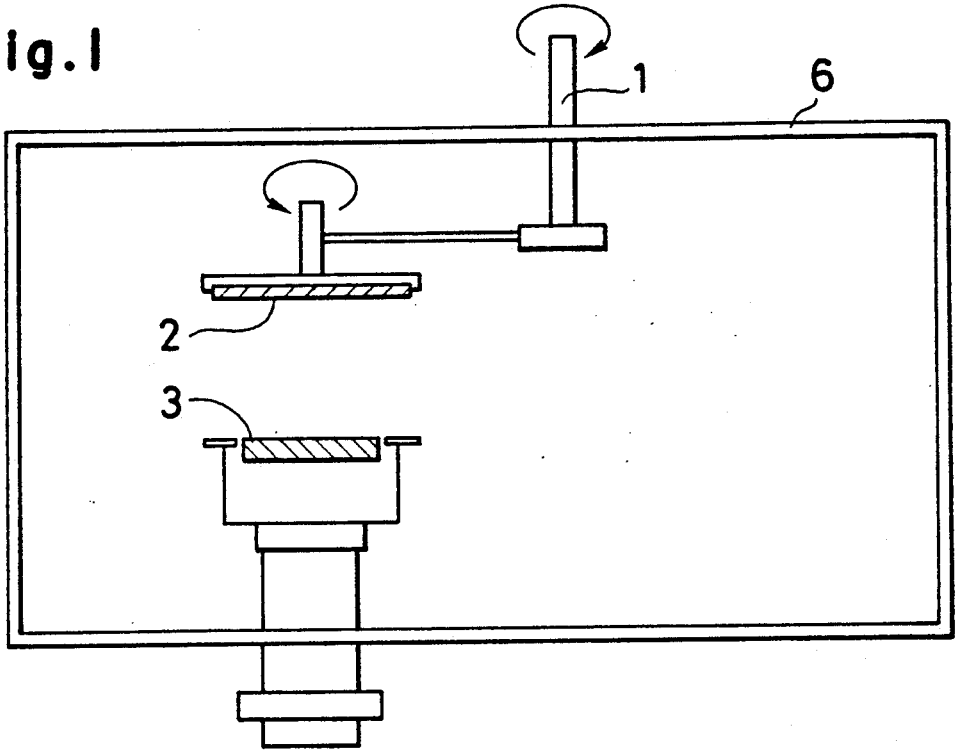
FIGS. 1 and 2 show apparatuses for preparing an alloy of the present invention.

The present invention aims to provide novel amorphous aluminum alloys of superior characteristics such as high corrosion resistance high wear resistance and considerable toughness.

It is generally known that an alloy has a crystalline structure in the solid state. However an alloy having a specific composition becomes amorphous by prevention of the formation of long-range order structure during solidification through, for example, rapid solidification from the liquid state, sputter deposition or plating under the specific conditions; or by destruction of the long-range order structure of the solid alloy through ion implantation which is also effective for supersaturation with necessary elements. The amorphous alloy thus formed is an extremely homogeneous single phase supersaturated solid solution containing sufficient amounts of various alloying elements beneficial in providing specific characteristics, such as high corrosion resistance, high mechanical strength and high toughness.

The present inventors carried out a series of searches and directed their attention to the outstanding properties of amorphous alloys. They found that amorphous alloys consisting of metals having high melting points and metals having low melting points can be prepared by sputter deposition method which does not require mixing of metallic elements by melting. The the present invention has been accomplished on the basis of this finding. Furthermore, the present inventors found that the alloys of the present invention possess extremely high corrosion resistance due to formation of protective surface films by spontaneous passivation even in very corrosive acids having a poor oxidizing power such as hydrochloric acids.

Table 1 shows the components and compositions of the alloys set forth in the claims.

TABLE 1

| | (atomic %) | | |
|---|---|---|---|
| Ta Nb (*1) | Mo, W (*2) | Ti, Zr (*3) | Al (*4) |
| 7–75 | | | Balance |
| At least 5 | | 7–75 (*5) | Balance |
| | 7–50 | | Balance |
| | At least 5 | 7–50 (*6) | Balance |
| 7–75 (*7) | Less than 50 | | Balance |
| At least 5 (*7) | Less than 50 | 7–75 (*8) | Balance |

*1: At least one element of Ta and Nb.
*2: At least one element of Mo and W.
*3: At least one element of Ti and Zr.
*4: Substantially Al.
*5: The sum of at least one element of Ta and Nb and at least one element of Ti and Zr.
*6: The sum of at least one element of Mo and W and at least one element of Ti and Zr.
*7: The sum of at least one element of Ta and Nb and at least one element of Mo and W.
*8: The sum of elements in three groups, that is, at least one element of Ta and Nb, at least one element of Mo and W and at least one element of Ti and Zr.

The amorphous alloys produced by sputter deposition are single-phase alloys in which the alloying elements exist in a state of uniform solid solution. Accordingly, they form an extremely uniform and highly corrosion-resistant protective passive film in a poorly oxidizing environment.

Metallic materials are readily dissolved in a poorly oxidizing very aggressive hydrochloric acid. Therefore, the metallic materials intended for use in such an environment should have an ability to form a stable protective passive film. This objective is achieved by an alloy containing effective elements as much as necessary. However, it is not desirable to add various alloying elements in large quantities to a crystalline metal, because the resulting alloy is of a multiple phase mixture, with each phase having different chemical properties, and is not so satisfactory in corrosion resistance as intended. Moreover, the chemical heterogeneity is rather harmful to corrosion resistance.

By contrast, the amorphous alloys of this invention are of homogeneous solid solution. Therefore, they homogeneously contain effective elements as much as required to form uniformly a stable passive film. Owing to the formation of this uniform passive film, the amorphous alloys of this invention exhibit a sufficiently high corrosion resistance.

In other words, metallic materials to withstand a poorly oxidizing hydrochloric acids should form a uniform, stable passive film in such an environment. Alloys of amorphous structure permit many alloying elements to exist in a form of single-phase solid solution, and also permit the formation of a uniform passive film.

The components and compositions of the alloys of this invention are specified as above for the following reasons:

Ta, Nb, Mo and W are able to form the amorphous structure when they coexist with Al. For the formation of the amorphous structure by sputtering, the Al alloys consisting of Al and at least one element of Ta and Nb are required to contain 7–75 at. % of at least one element of Ta and Nb, and similarly the Al alloys consisting of Al and at least one element of Mo and W are required to contain 7–50 at. % of at least one element of Mo and W. When Al alloys consist of at least one element of Ta and Nb and at least one element of Mo and W, the content of at least one element of Mo and W is not allowed to exceed 50 at. %, and the sum of at least one element of Ta and Nb and at least one element of Mo and W is required to be 7–75 at. % for the formation of the amorphous structure by sputtering. A portion of Ta, Nb, Mo and W in the Al-refractory metal alloys can be substituted with at least one element of Ti and Zr, but at least 5 at. % of at least one element of Ta, Nb, Mo and W should be contained for the formation of the amorphous structure.

Ta, Nb, Ti, Zr, Mo and W are able to form a protective passive film in a poorly oxidizing acid, and hence the amorphous alloys of the present invention have a sufficiently high corrosion resistance in corrosive environments such as hydrochloric acids.

Preparation of the alloys of the present invention is carried out by sputter deposition method. Sputtering is performed by using a sintered or alloyed crystalline target of multiple phases whose average composition is the same as the amorphous alloy to be prepared. Sputtering is also performed by using a target consisting of a metal sheet of one of constituents in the amorphous alloy to be prepared and other metal constituents placed on the metal sheet. In the present invention, it is difficult to form alloy targets of aluminum with valve metals, and hence targets consisting of an Al disc on which at least one element selected from valve metals is placed are used. The alloys of the present invention can be produced by using the valve-metal placed Al sheet target. The apparatus shown in FIG. 1 can be used. In order to avoid local compositional heterogeneity of sputtered alloys, it is desirable to carry out a rotation or revolution of the substrate disc 2 around a central axis 1 of the sputtering chamber 6 in addition to a rotation or revolution of the substrate disc itself around the center of the substrate disc. The orbit of the substrate disc is just above the center of the target 3.

Figure 2:
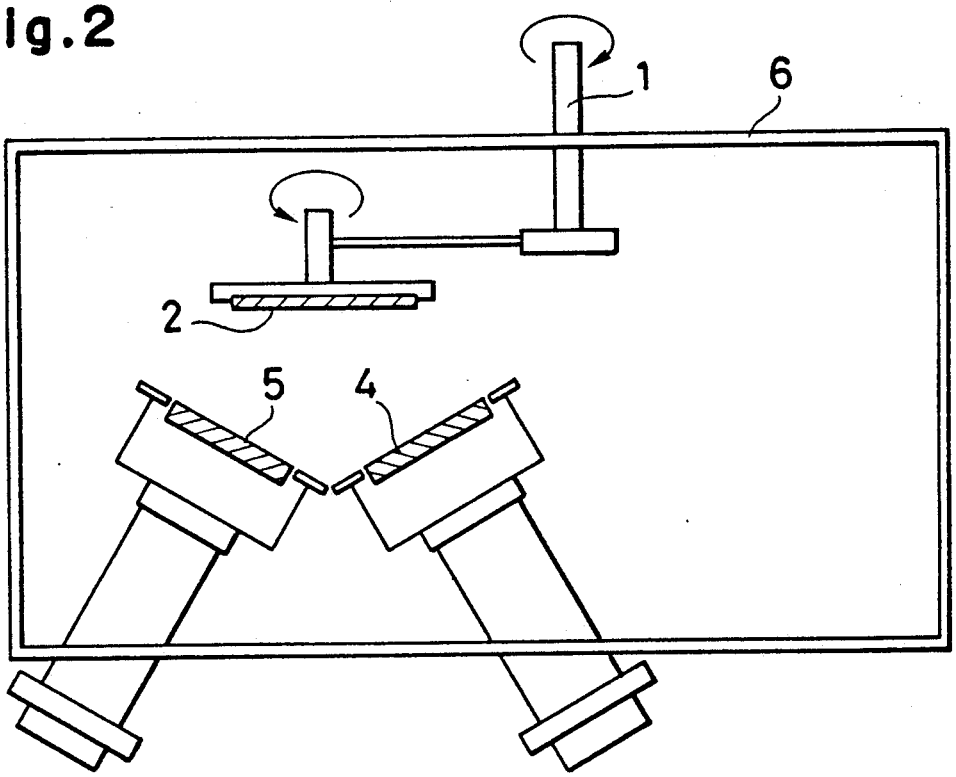

In order to widely change the composition of the amorphous alloy formed, the apparatus shown in FIG. 2 can be used. For instance if an Al disc is used as a target 4, a Ta-embeded Al disc is used as a target 5. These two targets are installed obliquely in the sputtering chamber 6, in such a way that the intersection of the normals to the centers of these two targets is on the orbit of the center of the substrate disc 2 revolving around a central axis 1 of the sputtering chamber 6 in addition to the rotation of the substrate disc itself around the center of the substrate disc. When these two targets are independently operated by two independent power sources, amorphous Al-Ta alloys are formed whose compositions are dependent upon the relative powers of the two targets. In this manner when different various combinations of the two targets are used, different amorphous alloys such as Al-Ta, Al-Nb, Al-Ta-Nb, Al-Ta-Ti, Al-Ta-Zr, Al-Ta-Ti-Zr, Al-Nb-Ti, Al-Nb-Zr, Al-Nb-Ti-Zr, Al-Ta-Nb-Ti, Al-Ta-Nb-Zr, Al-Ta-Nb-Ti-Zr, Al-Mo, Al-W, Al-Mo-W, Al-Mo-Ti, Al-Mo-Zr, Al-W-Ti, Al-W-Zr, Al-W-Ti-Zr, Al-Mo-W-Ti, Al-Mo-W-Zr, Al-Mo-W-Ti-Zr, Al-Ta-Mo,Al-Ta-W, Al-Ta-Mo-W, Al-Ta-Mo-Ti, Al-Ta-Mo-Zr, Al-Ta-Mo-Ti-Zr, Al-Ta-W-Ti, Al-Ta-W-Zr, Al-Ta-W-Ti-Zr, Al-Ta-Mo-W-Ti, Al-Ta-Mo-W-Zr, Al-Ta-Mo-W-Ti-Zr, Al-Nb-Mo, Al-Nb-W, Al-Nb-Mo-W,Al-Nb-Mo-Ti, Al-Nb-Mo-Zr, Al-Nb-Mo-Ti-Zr, Al-Nb-W-Ti, Al-Nb-W-Zr,Al-Nb-W-Ti-Zr, Al-Nb-Mo-W-Ti, Al-Nb-Mo-W-Zr, Al-Nb-Mo-W-Ti-Zr, Al-Ta-Nb-Mo, Al-Ta-Nb-W, Al-Ta-Nb-Mo-W, Al-Ta-Nb-Mo-Ti, Al-Ta-Nb-Mo-Zr, Al-Ta-Nb-Mo-Ti-Zr, Al-Ta-Nb-W-Ti, Al-Ta-Nb-W-Zr, Al-Ta-Nb-W-Ti-Zr, Al-Ta-Nb-Mo-W-Ti, Al-Ta-Nb-Mo-W-Zr and Al-Ta-Nb-Mo-W-Ti-Zr alloys, are formed.

The invention is now illustrated by the following examples:

EXAMPLE 1

The target consisted of four Ta discs of 20 mm diameter and 10 mm thickness placed symmetrically in an Al disc of 100 mm diameter and 6 mm thickness so as to place the center of the Ta discs on a concentric circle of 58 mm diameter on the surface of the Al disc. The sputtering apparatus shown in FIG. 1 was used. Substrates were an Al disc and two glasses which were revolved around the central axis of the sputtering chamber during revolution of the substrates themselves around the center of the substrates. Sputtering was carried out at the power of 640 watts under purified Ar stream of 5 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Al-19.7 at. % Ta alloy.

This alloy was spontaneously passive in 1 N HCl at 30° C., and the passivity breakdown potential of the alloy measured by anodic polarization in the 1 N HCl was 0.48 V (SCE) which was very high. Consequently this amorphous alloy is highly corrosion-resistant.

EXAMPLE 2

The sputtering apparatus shown in FIG. 2 was used in which Al and Ta target discs of 100 mm diameter and 6 mm thickness were installed. Substrates were an Al disc and two glasses which were revolved around the central axis of the sputtering chamber during revolution of the substrates themselves around the center of the substrates. Sputtering was carried out at the power of the Al target of 172 watts and at the power of the Ta target of 460 watts under purified Ar stream of 5 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Al-74.0 at. % Ta alloy.

This alloy was spontaneously passive in 1 N HCl at 30° C., and the passivity breakdown potential of the alloy measured by anodic polarization in the 1 N HCl was 1.54 V(SCE) which was extremely high. Consequently this amorphous alloy is highly corrosion-resistant.

EXAMPLE 3

An Nb-embeded target consisted of four Nb discs of 20 mm diameter and 10 mm thickness and four Nb discs of 10 mm diameter and 10 mm thickness embeded symmetrically in an Al disc of 100 mm diameter and 6 mm thickness so as to place the center of the Nb discs on a concentric circle of 58 mm diameter on the surface of the Al disc.

The sputtering apparatus shown in FIG. 2 was used in which an Nb target disc of 100 mm diameter and 6 mm thickness and the Nb-embeded Al target disc were installed. Substrates were an Al disc and two glasses which were revolved around the central axis of the sputtering chamber during revolution of the substrates themselves around the center of the substrates. Sputtering was carried out at the power of the Nb target of 140 watts and at the power of the Nb-embeded target of 246 watts under purified Ar stream of 5 ml/min at a vacuum of $1\times10^{-4}$ Torr.

X-ray diffraction of the sputter deposit thus prepared revealed the formation of an amorphous alloy. Electron probe microanalysis showed that the amorphous alloy consisted of Al-52.0 at. % Nb alloy.

This alloy was spontaneously passive in 1 N HCl at 30° C., and the passivity breakdown potential of the alloy measured by anodic polarization in the 1 N HCl 1.84 V(SCE) which was extremely high. Consequently this amorphous alloy is highly corrosion-resistant.

EXAMPLE 4

An Nb-embeded target consisted of four Nb discs of 20 mm diameter and 10 mm thickness and four Nb discs of 10 mm diameter and 10 mm thickness embeded symmetrically in an Al disc of 100 mm diameter and 6 mm thickness so as to place the center of the Nb discs on a concentric circle of 58 mm diameter on the surface of the Al disc.

The sputtering apparatus shown in FIG. 2 was used in which an Al target disc of 100 mm diameter and 6 mm thickness and the Nb-embeded Al target disc were installed. Substrates were an Al disc and two glasses which were revolved around the central axis of the sputtering chamber during revolution of the substrates themselves around the center of the substrates. Sputtering was carried out at the power of the Al target of 172 watts and at the power of the Nb-embeded target of 344 watts under purified Ar stream of 5 ml/min at a vacuum of $1\times10^{-4}$ Torr. X-ray diffraction of the sputter deposit thus prepared revealed the formation of an amorphous alloy. Electron probe microanalysis showed that the amorphous alloy consisted of Al 14.0 at. % Nb alloy.

This alloy was spontaneously passive in 1 N HCl at 30° C., and the passivity breakdown potential of the alloy measured by anodic polarization in the 1 N HCl was - 0.07 V(SCE) which was very high. Consequently this amorphous alloy is highly corrosion-resistant.

EXAMPLE 5

The sputtering apparatus shown in FIG. 2 was used in which various combinations of two targets, such as Ta-embeded Al and Nb-embeded Al targets, Ta- and Ti embeded Al target and Ta-embeded Al target, Ta-embeded Al target and Zr-embeded Al-target, Ta- and Nb-embeded Al target and Ti-embeded Al target, and Ta- and Nb-embeded Al target and Ti- and Zr-embeded Al target, were installed.

Sputtering conditions and procedures similar to those described in Examples 3 and 4 were applied. A variety of amorphous alloys shown in Table 2 were prepared. The fact that these alloys are all in the amorphous state was confirmed by X-ray diffraction.

These alloys were all spontaneously passive in 1 N HCl at 30° C., and their passivity breakdown potentials measured by anodic polarization in the 1 N HCl were very high as shown in Table 2. Consequently, these amorphous alloys were highly corrosion-resistant.

TABLE 2

Amorphous alloys and their passivity breakdown potentials measured in 1N HCl at 30° C.

| Alloy | Passivity Breakdown Potential V(SCE) |
|---|---|
| Al—7Ta | 0.08 |
| Al—15Ta | 0.10 |
| Al—22Ta | 0.55 |
| Al—37Ta | 0.67 |
| Al—48Ta | 0.73 |
| Al—52Ta | 0.79 |
| Al—7Nb | 0.07 |
| Al—22Nb | 0.59 |
| Al—33Nb | 0.81 |
| Al—42Nb | 0.99 |
| Al—22Ta—30Nb | 2.02 |
| Al—6Ta—30Ti | −0.15 |
| Al—37Ta—13Ti | 0.72 |
| Al—40Nb—15Ti | 1.12 |
| Al—41Ta—10Zr | 0.72 |
| Al—7Nb—40Zr | −0.25 |
| Al—39Nb—20Zr | 0.93 |
| Al—25Ta—23Nb—15Ti | 1.53 |
| Al—15Ta—35Nb—17Zr | 1.77 |
| Al—15Ta—15Nb—10Ti—10Zr | 0.58 |

EXAMPLE 6

The sputtering apparatus shown in FIG. 2 was used in which various combinations of two targets, such as Ta-embeded Al and Mo-embeded Al targets, Ta- and Ti-embeded Al and Mo-embeded Al targets, Ta- and Zr-embeded Al and Mo-embeded Al targets, Ta-embeded Al and W-embeded Al targets, Ta- and Mo-embeded Al and W-embeded Al targets, Ta- and Nb-embeded Al and Mo- and W-embeded Al targets, Ta-embeded Al and Ti- and Mo-embeded Al targets, Ta- and Ti-embeded Al and Mo- and W-embeded Al targets, Nb-embeded Al and W-embeded Al targets, Nb- and Mo-embeded Al and W-embeded Al targets, and Ti- and Zr-embeded Al and Mo- and W-embeded Al targets, were installed.

Sputtering conditions and procedures similar to those described in Examples 3 and 4 were applied. a variety of amorphous alloys shown in Table 3 were prepared. The fact that these alloys are all in the amorphous state was confirmed by X-ray diffraction.

These alloys were all spontaneously passive in 1 N HCl at 30° C., and their corrosion rates measured in the 1N HCl were very low as shown in Table 3. Consequently these amorphous alloys are highly corrosion-resistant.

TABLE 3

Amorphous alloys and their corrosion rates measured in 1N HCl at 30° C.

| Alloy | Corrosion Rate mm/year |
|---|---|
| Al—7Mo | $1 \times 10^{-1}$ |
| Al—12Mo | $8.7 \times 10^{-2}$ |
| Al—21Mo | $5.7 \times 10^{-2}$ |
| Al—33Mo | $3.6 \times 10^{-2}$ |

TABLE 3-continued

Amorphous alloys and their corrosion rates measured in 1N HCl at 30° C.

| Alloy | Corrosion Rate mm/year |
|---|---|
| Al—42Mo | $9.3 \times 10^{-3}$ |
| Al—49Mo | $6.7 \times 10^{-3}$ |
| Al—7W | $5.5 \times 10^{-2}$ |
| Al—15W | $3.3 \times 10^{-2}$ |
| Al—30W | $2.5 \times 10^{-2}$ |
| Al—45W | $1.8 \times 10^{-2}$ |
| Al—5Mo—2W | $4.0 \times 10^{-1}$ |
| Al—40Mo—8W | $1.3 \times 10^{-2}$ |
| Al—12Mo—30Ti | $1.5 \times 10^{-1}$ |
| Al—42Mo—6Ti | $1.8 \times 10^{-2}$ |
| Al—30Mo—14Zr | $7.5 \times 10^{-2}$ |
| Al—20W—18Ti | $6.1 \times 10^{-2}$ |
| Al—5W—2Zr | $2.4 \times 10^{-1}$ |
| Al—35W—12Zr | $4.4 \times 10^{-2}$ |
| Al—15Mo—15W—18Ti | $4.7 \times 10^{-2}$ |
| Al—30Mo—10W—8Zr | $1.7 \times 10^{-2}$ |
| Al—30W—6Ti—18Zr | $9.4 \times 10^{-2}$ |
| Al—1Mo—4W—1Ti—1Zr | $5.6 \times 10^{-1}$ |
| Al—2Ta—5Mo | $3.4 \times 10^{-1}$ |
| Al—29Ta—45W | $0.0 \times 10^{-4}$ |
| Al—1Ta—30Mo—18W | $8.1 \times 10^{-3}$ |
| Al—45Nb—10Mo | $4.4 \times 10^{-4}$ |
| Al—18Nb—40W | $3.6 \times 10^{-3}$ |
| Al—10Nb—15Mo—15W | $9.2 \times 10^{-3}$ |
| Al—8Ta—12Nb—15Mo | $2.5 \times 10^{-3}$ |
| Al—18Ta—10Nb—20W | $1.8 \times 10^{-3}$ |
| Al—30Ta—9Nb—8Mo—12W | $0.0 \times 10^{-4}$ |
| Al—18Ta—20Mo—10Ti | $2.0 \times 10^{-3}$ |
| Al—30Ta—10Mo—8Zr | $0.0 \times 10^{-4}$ |
| Al—20Ta—15Mo—13Ti—7Zr | $2.2 \times 10^{-3}$ |
| Al—15Ta—30W—8Ti | $8.8 \times 10^{-3}$ |
| Al—33Ta—17W—15Zr | $0.0 \times 10^{-4}$ |
| Al—42Ta—9W—13Ti—9Zr | $0.0 \times 10^{-4}$ |
| Al—12Ta—7Mo—15W—30Ti | $9.0 \times 10^{-3}$ |
| Al—20Ta—20Mo—9W—20Zr | $2.0 \times 10^{-3}$ |
| Al—8Ta—15Mo—10W—21Ti—18Zr | $1.0 \times 10^{-2}$ |
| Al—15Nb—13Mo—10Ti | $9.6 \times 10^{-2}$ |
| Al—20Nb—15Mo—10Zr | $1.3 \times 10^{-3}$ |
| Al—9Nb—20Mo—8Ti—8Zr | $5.9 \times 10^{-1}$ |
| Al—15Nb—31W—12Ti | $6.4 \times 10^{-2}$ |
| Al—35Nb—15W—10Zr | $8.9 \times 10^{-4}$ |
| Al—40Nb—9W—9Ti—15Zr | $8.5 \times 10^{-4}$ |
| Al—15Nb—8Mo—10W—26Ti | $2.7 \times 10^{-2}$ |
| Al—22Nb—18Mo—9W—20Zr | $7.6 \times 10^{-3}$ |
| Al—10Nb—15Mo—10W—20Ti—18Zr | $2.2 \times 10^{-2}$ |
| Al—8Ta—10Nb—10Mo—7Ti | $4.4 \times 10^{-3}$ |
| Al—15Ta—10Nb—9Mo—18Zr | $8.3 \times 10^{-4}$ |
| Al—12Ta—8Nb—10W—10Ti | $2.3 \times 10^{-3}$ |
| Al—10Ta—16Nb—9W—20Zr | $3.5 \times 10^{-3}$ |
| Al—10Ta—24Nb—15W—9Ti—9Zr | $3.0 \times 10^{-3}$ |
| Al—2Ta—9Nb—15Mo—7W—10Ti | $6.9 \times 10^{-2}$ |
| Al—15Ta—20Nb—9Mo—9W—15Zr | $8.1 \times 10^{-4}$ |
| Al—18Ta—10Nb—10Mo—10W—10Ti—9Zr | $7.9 \times 10^{-4}$ |

What is claimed is:

1. A corrosion-resistant sputtered amorphous aluminum-refractory metal alloy having an amorphous single phase and being free of metalloid elements, said alloy consisting of an element having a higher melting point than the boiling point of Al and consisting of 7–67 at % of at least one element selected from the group consisting of Ta and Nb with the balance being substantially Al, but, if the alloy is a binary Al-Ta alloy, the Ta content must be at least 22 at %.

2. A corrosion-resistant sputtered amorphous aluminum-refractory metal alloy having an amorphous single phase and being free of metalloid elements, said alloy consisting of an element having a higher melting point than the boiling point of Al and consisting of at least one element selected from the group consisting of Ta and Nb and at least one element selected from the group consisting of Ti and Zr, said at least one element selected from said group consisting of Ta and Nb being at least 7 at. %, the sum of the at least one element selected from said group of Ta and Nb and the at least one element selected from the group consisting of Ti and Zr being from 7 to 67 at. % with the balance being substantially Al.

3. A corrosion-resistant sputtered amorphous aluminum-refractory metal alloy having an amorphous single phase and being free of metalloid elements, said alloy consisting of an element having a higher metling point than the boiling point of Al and consisting of at least one element selected from the group consisting of Mo and W and at least one element selected from the group consisting of Ta and Nb, said at least one element selected from said group of Mo and W being less than 50 at. %, the sum of the at least one element selected from said group of Mo and W and the at least one element selected from said group of Ta and Nb being 7–67 at. % with the balance being substantially Al.

4. A corrosion-resistant sputtered amorphous aluminum-refractory metal alloy having an amorphous single phase and being free of metalloid elements, said alloy comprising:

at least an element having a higher melting point than the boiling point of Al and consisting of at least one element selected from the group consisting of Mo and W, at least one element selected from the group consisting of Ta and Nb and at least one element selected from the group consisting of Ti and Zr, the at least one element selected from said group of Mo and W being less than 50 at. %, the sum of the at least one element selected from said group of Mo and W and the at least one element selected from said group of Ta and Nb being at least 7 at. %, the sum of the at least one element selected from said group of Mo and W, the at least one element selected from said group of Ta and Nb and the at least one element selected from said group of Ti and Zr being 7 to 67 at. % with the balance being substantially Al.

* * * * *